US010403212B2

(12) United States Patent
Chen et al.

(10) Patent No.: US 10,403,212 B2
(45) Date of Patent: Sep. 3, 2019

(54) DISPLAY PANEL, METHOD FOR DISPLAYING ON THE SAME, AND DISPLAY DEVICE

(71) Applicant: Shanghai Tianma AM-OLED Co.,Ltd., Shanghai (CN)

(72) Inventors: Xian Chen, Shanghai (CN); Lijing Han, Shanghai (CN); Lu Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/789,855

(22) Filed: Oct. 20, 2017

(65) Prior Publication Data

US 2018/0374426 A1 Dec. 27, 2018

(30) Foreign Application Priority Data

Jun. 26, 2017 (CN) ..... 2017 1 0495628

(51) Int. Cl.
*G09G 3/30* (2006.01)
*G09G 3/32* (2016.01)
(Continued)

(52) U.S. Cl.
CPC ..... *G09G 3/3291* (2013.01); *G09G 3/3225* (2013.01); *G09G 3/3233* (2013.01);
(Continued)

(58) Field of Classification Search
CPC ..... G02F 2001/133388; G09G 3/3208; G09G 3/3225; G09G 3/3233; G09G 3/3258;
(Continued)

(56) References Cited

U.S. PATENT DOCUMENTS 7,130,486 B2 10/2006 Eggers et al.
2003/0142850 A1* 7/2003 Eggers ..... G06K 9/00825 382/104

(Continued)

FOREIGN PATENT DOCUMENTS

CN 1175007 A 3/1998
CN 1697002 A 11/2005

(Continued)

*Primary Examiner* — Michael J Eurice
(74) *Attorney, Agent, or Firm* — Alston & Bird LLP

(57) ABSTRACT

The disclosure discloses a display panel, a method for displaying on the same, and a display device, where a display region is divided into a central display region, and an edge display region surrounding the central display region; and the brightness of a pixel in the edge display region is lower than the brightness of a pixel in the central display region at each grayscale, so that while a picture is being displayed, the brightness in the edge display region is lower than the brightness in the central display region, but the edge display region is adjacent to an edge frame of the display panel, and human eyes perceive higher brightness in the edge display region than the real brightness in the edge display region, so that the brightness in the central display region perceived by the human eyes agrees with the brightness in the edge display region.

19 Claims, 7 Drawing Sheets

(51) Int. Cl.

| | |
|---|---|
| ***G09G 5/10*** | (2006.01) |
| ***H01L 27/32*** | (2006.01) |
| ***H01L 51/00*** | (2006.01) |
| ***H04N 5/57*** | (2006.01) |
| ***G09G 3/3291*** | (2016.01) |
| ***G09G 3/3225*** | (2016.01) |
| ***G09G 3/3233*** | (2016.01) |
| *G09G 3/3258* | (2016.01) |
| *G09G 3/36* | (2006.01) |
| *G09G 3/3208* | (2016.01) |

(52) U.S. Cl.
CPC ..... *G09G 5/10* (2013.01); *G09G 3/3208* (2013.01); *G09G 3/3258* (2013.01); *G09G 3/3648* (2013.01); *G09G 2300/0426* (2013.01); *G09G 2300/0814* (2013.01); *G09G 2310/027* (2013.01); *G09G 2310/0262* (2013.01); *G09G 2320/0233* (2013.01); *G09G 2340/145* (2013.01); *G09G 2380/02* (2013.01)

(58) Field of Classification Search
CPC ..... G09G 3/3291; G09G 3/3648; G09G 2300/0413; G09G 2300/0842; G09G 2300/0439; G09G 2310/0232; G09G 2310/027; G09G 2320/0233; G09G 2320/0276; G09G 2320/0285; G09G 2320/04; G09G 2340/145; G09G 5/10
See application file for complete search history.

(56) References Cited

U.S. PATENT DOCUMENTS

2004/0100463 A1* 5/2004 Miyagawa ..... G09G 3/3233 345/212
2004/0252088 A1* 12/2004 Kawachi ..... H01L 27/3246 345/76
2005/0253825 A1* 11/2005 Kawamura ..... G09G 3/22 345/204
2006/0066722 A1* 3/2006 Yin ..... H04N 7/181 348/143
2007/0080905 A1* 4/2007 Takahara ..... G09G 3/3233 345/76
2007/0109468 A1* 5/2007 Oku ..... G02F 1/133514 349/110
2008/0030514 A1* 2/2008 Ooishi ..... G06T 1/60 345/530
2008/0198103 A1* 8/2008 Toyomura ..... G09G 3/3233 345/77
2008/0225027 A1* 9/2008 Toyomura ..... G09G 3/3233 345/204
2008/0238936 A1* 10/2008 Kim ..... G09G 3/3648 345/618
2008/0252628 A1* 10/2008 Han ..... G09G 5/10 345/207
2008/0273002 A1* 11/2008 Kim ..... G02F 1/13452 345/98
2011/0109299 A1* 5/2011 Chaji ..... G09G 3/3283 324/76.11
2011/0157257 A1* 6/2011 Bennett ..... G06F 3/14 345/690
2013/0181605 A1* 7/2013 Chang ..... H05B 37/00 315/32
2013/0278488 A1* 10/2013 Huo ..... G06T 17/00 345/87
2014/0111854 A1* 4/2014 Kroon ..... G02B 27/2214 359/463
2015/0002563 A1* 1/2015 Chen ..... G09G 3/36 345/697
2015/0123885 A1* 5/2015 Adachi ..... G09G 3/3208 345/77
2015/0321606 A1* 11/2015 Vartanian ..... G02B 27/0101 348/148
2015/0356924 A1* 12/2015 Chen ..... G09G 3/3233 345/690
2015/0379927 A1* 12/2015 Cai ..... G09G 3/3233 345/214
2016/0163247 A1* 6/2016 Lee ..... G09G 3/3233 345/77
2016/0306247 A1* 10/2016 Ito ..... G02F 1/1368
2016/0307987 A1* 10/2016 Rankov ..... H01L 27/3246
2016/0328090 A1* 11/2016 Klinghult ..... G06F 3/0428
2017/0025051 A1* 1/2017 Li ..... G09G 3/006
2017/0220149 A1* 8/2017 Jin ..... G02F 1/13338
2018/0061905 A1* 3/2018 Choi ..... G09G 3/3233
2018/0159038 A1* 6/2018 Leng ..... H01L 51/5206
2018/0190190 A1* 7/2018 Xi ..... G09G 3/3225
2018/0269397 A1* 9/2018 Xin ..... H01L 51/0011

FOREIGN PATENT DOCUMENTS

CN 1967635 A 5/2007
CN 101093635 A 12/2007
CN 101281302 A 10/2008

* cited by examiner

DISPLAY PANEL, METHOD FOR DISPLAYING ON THE SAME, AND DISPLAY DEVICE

CROSS-REFERENCE TO RELATED APPLICATIONS

This application claims the priority to Chinese Patent Application No. 201710495628.7, filed on Jun. 26, 2017, the content of which is hereby incorporated by reference in its entirety.

FIELD OF INVENTION

The present disclosure relates to the field of display technologies, and particularly to a display panel, a method for displaying on the same, and a display device.

BACKGROUND

As sciences and technologies are being advanced constantly, display technologies have been increasingly widely applied in mobile phones, wearable devices, etc., and also their users have been increasingly interested in their display effect. If an existing display screen is emitting light, then the light may be emitted in the display region in a bright state, but not emitted in a peripheral circuit area in a dark state. If human eyes are watching the display screen, then there may be such a sharp difference between the bright state at the edge of the display screen, and the dark state in the peripheral circuit area where no light is emitted due to the Mach Band effect that forms the perspective of subjective vision. There is such a distinct contour at the edge of the display region on the display screen that there is a brighter display defect at the edge of the display region than the center thereof. The Mach Band effect refers to a subjective fringing contrast effect. If two blocks at different brightness are observed, then the difference in brightness at their boundaries may be enhanced, thus making the contour of the display region extremely distinct.

Accordingly, how to alleviate a visual effect on the display screen from being affected by the Mach Band effect is a technical problem highly desirable to be addressed by those skilled in the art.

BRIEF SUMMARY

In view of this, embodiments of the disclosure provide a display panel, a method for displaying on the same, and a display device so as to address the display defect of high brightness at the edge of a display region than the center thereof due to the Mach Band effect.

An embodiment of the disclosure provides a display panel including a display region, wherein there are a plurality of pixels arranged in the display region, wherein the display region includes a central display region, and an edge display region surrounding the central display region; and a brightness of a pixel in the edge display region is lower than a brightness of a pixel in the central display region at each grayscale.

Correspondingly an embodiment of the disclosure further provides a display device including a display panel, wherein there are a plurality of pixels arranged in a display region of the display panel, wherein the display region includes a central display region, and an edge display region surrounding the central display region; and a brightness of a pixel in the edge display region is lower than a brightness of a pixel in the central display region at each grayscale.

Correspondingly an embodiment of the disclosure further provides a method for displaying on a display panel including a display region, wherein there are a plurality of pixels arranged in the display region, wherein the display region includes a central display region, and an edge display region surrounding the central display region; and the display method includes: while a picture is displayed, controlling the brightness of a pixel in the edge display region to be lower than the brightness of a pixel in the central display region at each grayscale.

DETAILED DESCRIPTION OF THE EMBODIMENTS

Figure 1:
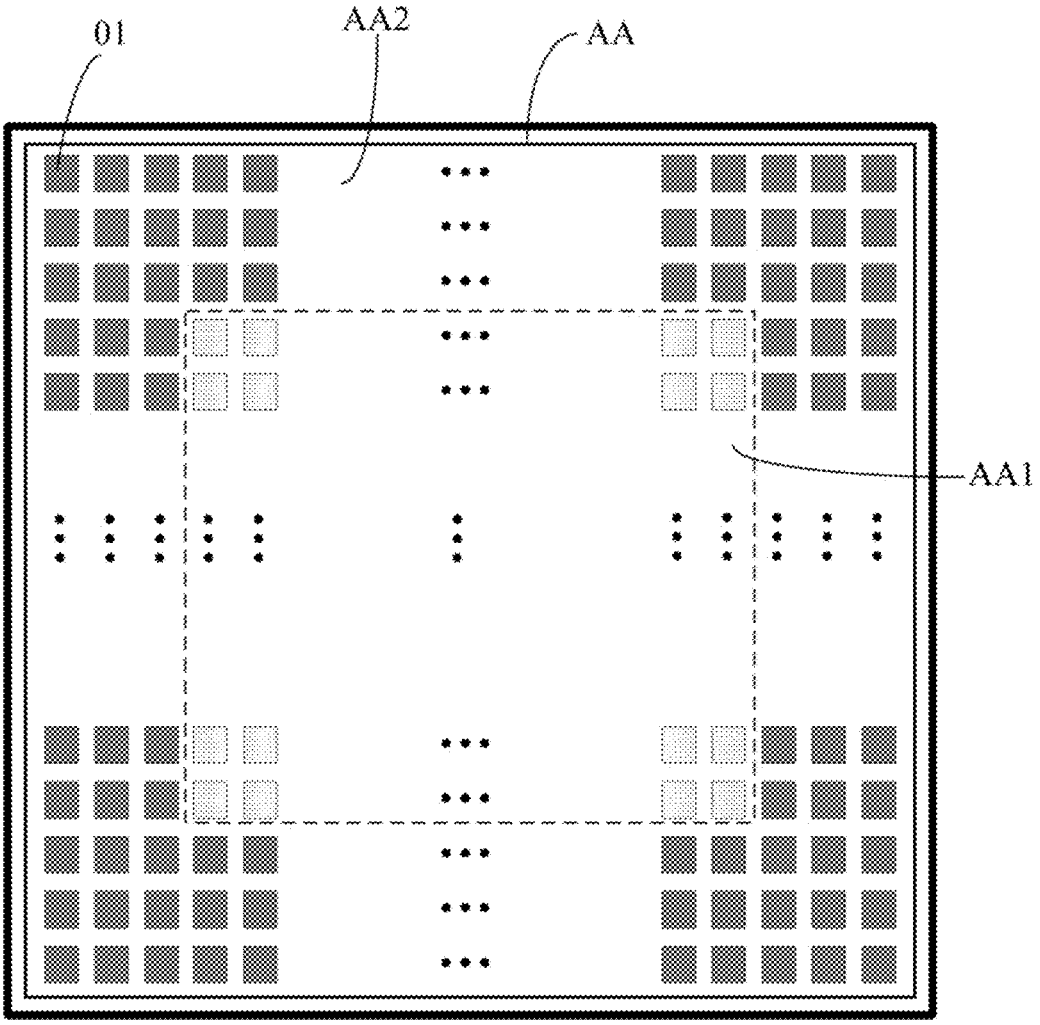
FIG. 1 illustrates a schematic diagram of a brightness distribution on a display panel according to an embodiment of the disclosure.

In order to make the objectives, technical solutions, and advantages of the disclosure more apparent, the disclosure will be described below in further details with reference to the drawings, and apparently the embodiments to be described below are only a part but not all of the embodiments of the disclosure. Based upon the embodiments here of the disclosure, all the other embodiments which can occur to those ordinarily skilled in the art without any inventive effort shall fall into the scope of the disclosure as claimed.

The shapes and sizes of respective components in the drawings are not intended to reflect their real proportions, but only intended to illustrate the disclosure of the disclosure.

An embodiment of the disclosure provides a display panel as illustrated in FIG. 1 which is a schematic diagram of a brightness distribution on the display panel according to the embodiment of the disclosure, where the display panel includes a display region AA in which there are a plurality of pixels 01 arranged.

The display region AA includes a central display region AA1, and an edge display region AA2 surrounding the central display region AA1.

For each grayscale, the brightness of a pixel 01 in the edge display region AA2 is lower than the brightness of a pixel 01 in the central display region AA1. For example, the same grayscale is displayed at all the pixels 01 in the display region AA, and if the brightness of each pixel 01 in the central display region AA1 is 100%, then the brightness of each pixel 01 in the edge display region AA2 is lower than 100%.

In the display panel according to the embodiment of the disclosure, the display region is divided into the central display region and the edge display region surrounding the central display region. The brightness of a pixel in the edge display region is lower than the brightness of a pixel in the central display region at each grayscale, so that while a picture is being displayed, the brightness in the edge display region is lower than the brightness in the central display region. However, the edge display region is adjacent to an edge frame of the display panel where no light is emitted, and human eyes perceive higher brightness in the edge display region than the real brightness in the edge display region due to the Mach Band effect, so that the brightness in the central display region perceived by the human eyes agrees with the brightness in the edge display region. Thus alleviating the problem in the existing display panel of such higher brightness in the edge display region than the brightness in the central display region that results in a distinct contour at the edge of the display region.

It shall be noted that in order to distinguish the different brightness distribution of pixels in the display region from that on the existing display panel in the drawings, the brightness of a pixel is represented as a filled pattern in the pixel in such a way that if the filled pattern in the pixel is darker, then the brightness of the pixel at the same grayscale is lower.

Particularly in the display panel according to the embodiment of the disclosure, the grayscale refers to a level of brightness on the display panel. Taking the display panel with 256 grayscales as an example, the brightness is divided into 256 levels from the brightest to the darkest. In the existing display panel, the brightness at the respective pixels is uniform at each grayscale. In the display panel according to the embodiment of the disclosure, there are 256 levels of brightness for the pixels in the central display region, and also 256 levels of brightness for the pixels in the edge display region. However, the brightness of a pixel in the edge display region is lower than the brightness of a pixel in the central display region at the same grayscale, i.e., at the same level of brightness.

Particularly there is a difference in brightness at the edge of the display region due to the Mach Band effect, so in the display panel according to the embodiment of the disclosure, the width of the edge display region may not be too large. If the width thereof is too large, then there may be a display defect of the lower brightness in the edge display region than the brightness in the central display region.

Particularly the width of the edge display region is further dependent upon the size and the Pixels Per Inch (PPI) of the display panel. If the size of the display panel is larger, then the width of the edge display region may be set larger, and if the size of the display panel is smaller, then the width of the edge display region may be set smaller. If the PPI of the display panel is larger, than there may be a larger number of pixels in the edge display region, and if the PPI of the display panel is smaller, than there may be a smaller number of pixels in the edge display region, particularly dependent upon the width of a real area with the display defect on the display panel, although the embodiment of the disclosure will not be limited thereto.

Particularly the tests in the art showed that if the same grayscale is displayed at all the pixels of the display panel, and if the width of the edge display region is greater than approximately the width of 15 pixels, there may be such a display defect perceivable to the human eyes that the brightness in the edge display region is lower than the brightness in the central display region. That is, the problem of a blurry contour at the edge of the display region may occur, although the problem of a distinct contour at the edge of the display region on the display panel can be alleviated by making the brightness of a pixel in the edge display region lower than the brightness of a pixel in the central display region. Accordingly in the display panel according to the embodiment of the disclosure, if the width of the edge display region is the width of 1 to 10 pixels, then there will not be a difference in brightness between the edge display region and the central display region perceivable to the human eyes. Furthermore those skilled in the art shall appreciate that the width of the edge display region in the embodiment of the disclosure will not be limited to the width of 1 to 10 pixels, but if there is a larger area with the display defect on the display panel, then the width of the edge display region may be set larger, although the embodiment of the disclosure will not be limited thereto.

Particularly in the display panel according to the embodiment of the disclosure, the width of the edge display region may not be too small, and if the width thereof is too small, then the difference in brightness between the edge display region and the central display region may not be completely eliminated although the difference in brightness is lowered.

Optionally in the display panel according to the embodiment of the disclosure, as illustrated in Table 1, preferably the width of the edge display region AA2 is set to be the width of 3 to 5 pixels 01, and in this case, the difference in brightness between the edge display region and the central display region can be visually eliminated as long as the brightness of the pixels in the edge display region is set as appropriate.

TABLE 1

Comparative table of display effects corresponding to different values of brightness in the edge display region

| The ratio of brightness in the edge display region to brightness in the central display region | Distinctness of a contour at the edge of the display region on the display panel |
|---|---|
| 90% | 10 |
| 80% | 9 |
| 70% | 7 |
| 60% | 3 |
| 50% | 3 |
| 40% | 2 |
| 30% | 2 |
| 20% | 1 |
| 10% | 1 |
| 5% | 1 |

Particularly in order to make the brightness in the edge display region on the display panel agree with the brightness in the central display region thereon, further tests were made on display effects on the display panel at different values of the brightness in the edge display region. Particularly in the 1.3-inch display screen with the PPI of 278, an experiment was made on the edge display region with a width of 5 pixels by way of an example, but the detailed description of the technical solution according to the disclosure will apply to the edge display region with another width. If the same grayscale is displayed at all the pixels on the display panel, then the display effects on the display panel may be as depicted in Table 1 at different values of the brightness in the edge display region.

It shall be noted that the distinctness of a contour at the edge of the display region on the display panel is represented as a numeral in Table 1, where a larger numeral represents the more significant Mach Band effect on the display panel. If the numeral is less than 3, then the Mach Band effect on the display panel may be very insignificant because the contour at the edge of the display region on the display panel has been greatly alleviated.

As can be apparent from the results of the tests, if the brightness in the edge display region is lower than the brightness in the central display region by a factor of 60%, then the difference in brightness between the central display region and the edge display region can be visually eliminated to thereby alleviate in effect the distinctness of the contour at the edge of the display region on the display panel.

Accordingly, particularly in the display panel according to an embodiment of the disclosure, the display effect will be better if the brightness of a pixel in the edge display region is no greater than 60% of the brightness of a pixel in the central display region at each grayscale. With this design, the difference in brightness between the central display region and the edge display region can be visually eliminated to thereby alleviate in effect the distinctness of the contour at the edge of the display region on the display panel.

Particularly since no light is emitted at the edge of the display panel, i.e., the edge frame of the display panel, and the brightness in the central display region on the display panel is the highest, in order to alleviate the Mach Band effect, i.e., the difference in brightness. The brightness in the edge display region shall become lower at a shorter distance from the edge frame of the display panel and higher at a shorter distance from the central display region.

Figure 2:
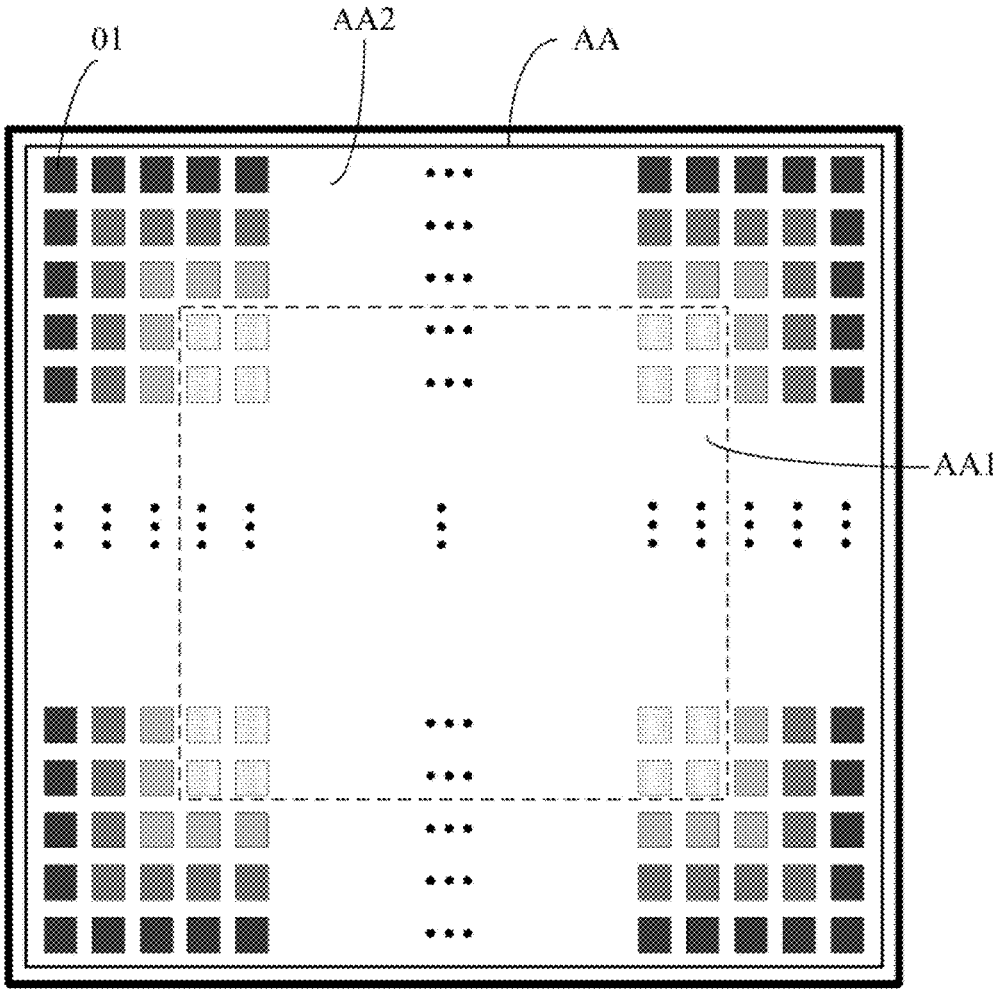
FIG. 2 illustrates a schematic diagram of another brightness distribution on a display panel according to an embodiment of the disclosure.
Figure 3:
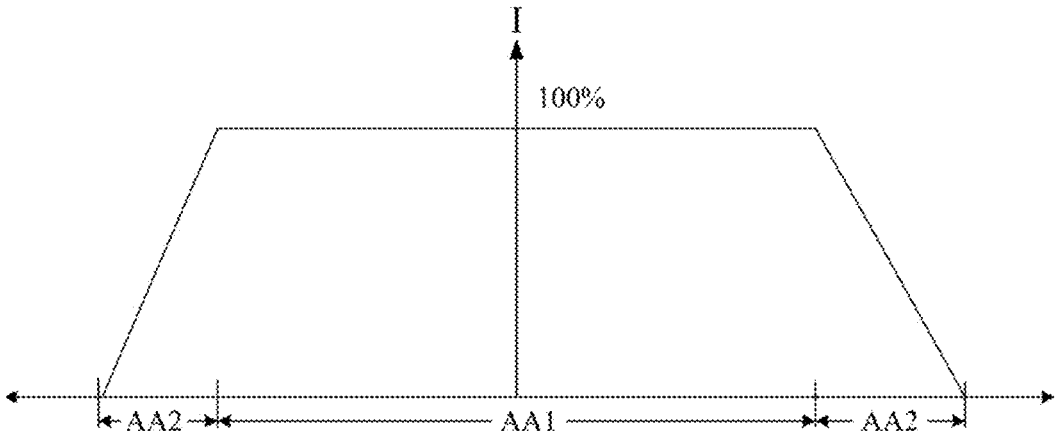
FIG. 3 illustrates a brightness distribution curve of pixels in the row direction or the column direction on a display panel, on which a grayscale picture is displayed, according to an embodiment of the disclosure.

Accordingly, particularly in the display panel according to the embodiment of the disclosure, as illustrated in FIG. 2 and FIG. 3, FIG. 2 illustrates a schematic diagram of another brightness distribution on a display panel according to an embodiment of the disclosure. FIG. 3 illustrates a brightness distribution curve of pixels in the row direction or the column direction on a display panel, on which a grayscale picture is displayed, according to an embodiment of the disclosure. The brightness of a pixel 01 in the edge display region AA2 becomes lower at a longer distance from the central display region AA1 at each grayscale, that is, there is lower brightness I of a pixel 01 in the edge display region AA2 at a shorter distance from the edge frame of the display panel to thereby lower the brightness contrast between the edge of the display panel and the edge display region AA2. There is higher brightness I of a pixel 01 in the edge display region AA2 at a shorter distance from the central display region AA1 to thereby lower the brightness contrast between the edge display region AA2 and the central display region AA1, so that the difference in brightness between the central display region and the edge display region can be visually eliminated to thereby alleviate in effect the distinctness of the contour at the edge of the display region on the display panel.

Optionally in the display panel according to the embodiment of the disclosure, the brightness of a pixel in the edge display region becomes lower in proportion at a longer distance from the central display region at each grayscale. For example, there are 5 pixels in the edge display region, and the brightness of the respective pixels may be 65%, 50%, 35%, 20%, and 5% in sequence at a longer distance from the central display region at the same grayscale, although the embodiment of the disclosure will not be limited thereto.

Particularly if there is lower brightness of a pixel in the edge display region immediately adjacent to the edge frame of the display panel, then there will be a smaller brightness contrast between the edge display region and the edge frame of the display panel, thus the Mach Band effect will be weaker. An experiment was conducted on the 1.3-inch display screen with the PPI of 278, where the edge display region has the width of 5 pixels, and the brightness of the closest row of pixels to the central display region is 60%, for example, while the other factors remain as they are. Table 2 below depicts display effects on the display panel at different values of brightness of the furthest row of pixels from the central display region.

TABLE 2

Comparative table of a display effect as a function of brightness of the furthest pixels from the central display region

| The ratio of brightness of the furthest row of pixels from the central display region to brightness of pixels in the central display region | Distinctness of a contour at the edge of the display region on the display panel |
|---|---|
| 20% | 3 |
| 15% | 3 |
| 10% | 2 |
| 7% | 2 |
| 5% | 1 |
| 3% | 1 |
| 1% | 1 |

It shall be noted that the distinctness of a contour at the edge of the display region on the display panel is represented as 3 indicating somewhat distinctness, 1 indicating indistinctness, and 2 indicating a middle between 3 and 1.

Optionally in the display panel according to the embodiment of the disclosure, if the brightness of the furthest pixels in the edge display region from the central display region is not greater than 5% of the brightness of the pixels in the central display region at each grayscale, then the Mach Band effect on the display panel may be completely eliminated although the embodiment of the disclosure will not be limited thereto.

Particularly if the brightness of pixels in the edge display region immediately adjacent to the central display region is closer to the brightness of pixels in the central display region, then it will be easier to visually avoid the difference in brightness between the central display region and the edge display region. An experiment was conducted on the 1.3-inch display screen with the PPI of 278, where the edge display region has the width of 5 pixels, and the brightness of the furthest row of pixels from the central display region is 5%, for example, while the other factors remain as they are. Table 3 below depicts display effects on the display panel at different values of brightness of the closest row of pixels to the central display region.

TABLE 3

| Comparative table of a display effect as a function of brightness of the closet pixels to the central display region | |
|---|---|
| The ratio of brightness of the nearest row of pixels from the central display region to brightness of pixels in the central display region | Distinctness of a contour at the edge of the display region on the display panel |
| 20% | 2 |
| 30% | 2 |
| 40% | 1 |
| 50% | 1 |
| 60% | 1 |
| 70% | 2 |
| 80% | 3 |

It shall be noted that the distinctness of a contour at the edge of the display region on the display panel is represented as 3 indicating somewhat distinctness, 1 indicating indistinctness, and 2 indicating a value in between 3 and 1.

Optionally in the display panel according to the embodiment of the disclosure, if the brightness of the pixels in the edge display region immediately adjacent to the central display region is 40% to 60% of the brightness of the pixels in the central display region at each grayscale, then the Mach Band effect on the display panel may be completely eliminated although the embodiment of the disclosure will not be limited thereto.

Taking as an example the display panel including the edge display region with the width of 3 pixels, there are 3 rows of pixels in the edge display region, where the brightness of the closest row of pixels to the central display region is 40% to 60% of the brightness of the pixels in the central display region. The brightness of the furthest row of pixels from the central display region is not greater than 5% of the brightness of the pixels in the central display region, and the brightness of the middle row of pixels in the edge display region may be controlled to range from greater than 5% of the brightness of the pixels in the central display region, and less than 40% of the brightness of the pixels in the central display region. For example, the brightness of the middle row of pixels is 10% to 30% of the brightness of the pixels in the central display region. Those skilled in the art shall appreciate that both the width of the edge display region and the brightness in the edge display region can be determined as needed for a particular design of the display panel although the embodiment of the disclosure will not be limited thereto.

Particularly the display panel can be varied as long as the brightness of a pixel in the edge display region on the display panel is no greater than the brightness of a pixel in the central display region thereon, without departing from the scope of the disclosure, the display panel will be described below in details in connection with particular embodiments thereof, but the following embodiments are intended to better illustrate the disclosure, but not to limit the disclosure thereto.

Figure 4:
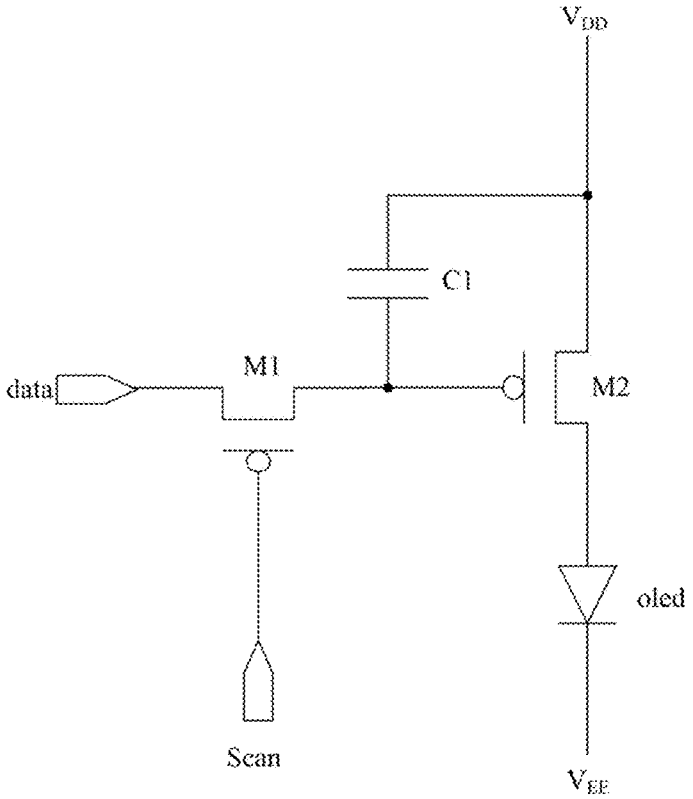
FIG. 4 illustrates a schematic structural diagram of a circuit for a pixel on a display panel according to an embodiment of the disclosure.

Particularly if the display panel is an organic light-emitting display panel which is driven by current, then the brightness of light emitted by the display panel may be controlled using the current. As illustrated in FIG. 4, which is a schematic structural diagram of a circuit for a pixel on a display panel according to an embodiment of the disclosure, a pixel 01 includes at least one switch transistor M1, a driver transistor M2, a light-emitting diode OLED (organic light emitting diode), and a storage capacitor C1, where if the switch transistor M1 is controlled by a scan line Scan to be switched on, data voltage $V_{data}$ on a data line Data may be written into the storage capacitor C1; and if the switch transistor M1 is controlled by the scan line Scan to be switched off, then gate voltage stored in the storage capacitor C1 may enable the driver transistor M2 to produce current to drive the light-emitting diode oled so that the light-emitting diode oled is emitting light constantly for a frame. Here the equation of saturated current of the driver transistor M2 is:

$$I = \frac{1}{2} \cdot \mu_n \cdot Cox \cdot \frac{W}{L} \cdot (V_{GS} - Vth)^2 = \frac{1}{2} \cdot \mu_n \cdot Cox \cdot \frac{W}{L} \cdot [(V_{data} - V_{DD}) - Vth]^2,$$

Where I represents the current flowing through the driver transistor M2, $\mu_n$ represents a mobility of carriers of the driver transistor, Cox represents a gate oxide layer capacitor in the driver transistor, W/L represents the width-to-length ratio of the channel of the driver transistor, $V_{GS}$ represents the difference in voltage between the gate and the source of the driver transistor M2, and Vth represents threshold voltage of the driver transistor M2.

In the organic light-emitting display panel, the brightness of the pixel is determined by the current flowing through the driver transistor, so in the display panel according to the embodiment of the disclosure, the brightness of the pixel in the edge display region can be lowered by varying at least one of: the mobility of the driver transistor, the width-to-length ratio of the channel of the driver transistor, the gate oxide layer capacitor of the driver transistor, or the data voltage on the data line Data, although the embodiment of the disclosure will not be limited thereto.

Particularly it is not easy to control the gate oxide layer capacitor of the driver transistor and the mobility of the driver transistor in a process, so in the display panel according to the embodiment of the disclosure, the width-to-length ratio of the channel of the driver transistor, or the data voltage on the data line can be varied so that the brightness of a pixel in the edge display region is lower than the brightness of a pixel in the central display region.

Particularly in the display panel according to the embodiment of the disclosure, as illustrated in FIG. 4, each pixel 01 includes at least one switch transistor M1, a driver transistor M2, and a light-emitting diode OLED, where an output end of the switch transistor M1 is electrically connected with the gate of the driver transistor M2, and an output end of the driver transistor M2 is electrically connected with an input end of the light-emitting diode OLED.

The width-to-length ratio of the channel of the driver transistor of the pixel in the central display region is greater than the width-to-length ratio of the channel of the driver transistor of the pixel in the edge display region, so that the brightness of the pixel in the edge display region is lower than the brightness of the pixel in the central display region at each grayscale.

Particularly in the display panel according to an embodiment of the disclosure, the width-to-length ratio of the channel of the driver transistor of the pixel in the edge display region becomes smaller at a longer distance from the central display region, so that the brightness of the pixel in the edge display region becomes lower at a longer distance from the central display region at each grayscale.

Particularly the current of the driver transistor in the organic light-emitting display panel is in direct proportion to the brightness of the pixel in some range, so in the display panel according to the embodiment of the disclosure, the width-to-length ratio of the channel of the driver transistor of the furthest pixel in the edge display region from the central display region is no greater than 5% of the width-to-length ratio of the channel of the driver transistor of the pixel in the central display region. The width-to-length ratio of the channel of the driver transistor of the pixel in the edge display region immediately adjacent to the central display region is 40% to 60% of the width-to-length ratio of the channel of the driver transistor of the pixel in the central display region.

Particularly in the display panel according to an embodiment of the disclosure, the width-to-length ratio of the channel of the driver transistor refers to the ratio of the width of the channel to the length of the channel of the driver transistor, so the width-to-length ratio of the channel of the driver transistor can be varied by varying the length of the channel of the driver transistor, the width of the channel of the driver transistor, or both the length of the channel and the width of the channel of the driver transistor. However from the perspective of making the process less difficult, it may be easier to vary only the length of the channel, or the width of the channel of the driver transistor as opposed to varying both the length of the channel and the width of the channel of the driver transistor.

Particularly in the display panel according to the embodiment of the disclosure, the widths of the channels of all the driver transistors are the same, so that only the lengths of the channels of the driver transistor of the pixels in the edge display region are made greater than the lengths of the channels of the driver transistor of the pixels in the central display region.

Optionally in the display panel according to the embodiment of the disclosure, the length of the channel of the driver transistor of the pixel in the edge display region becomes larger at a longer distance from the central display region.

Particularly in the display panel according to the embodiment of the disclosure, the lengths of the channels of all the driver transistors are the same, so that the widths of the channels of the driver transistor of the pixels in the edge display region are less than the widths of the channels of the driver transistor of the pixels in the central display region.

Optionally in the display panel according to the embodiment of the disclosure, the width of the channel of the driver transistor of the pixel in the edge display region becomes smaller at a longer distance from the central display region.

Figure 5:
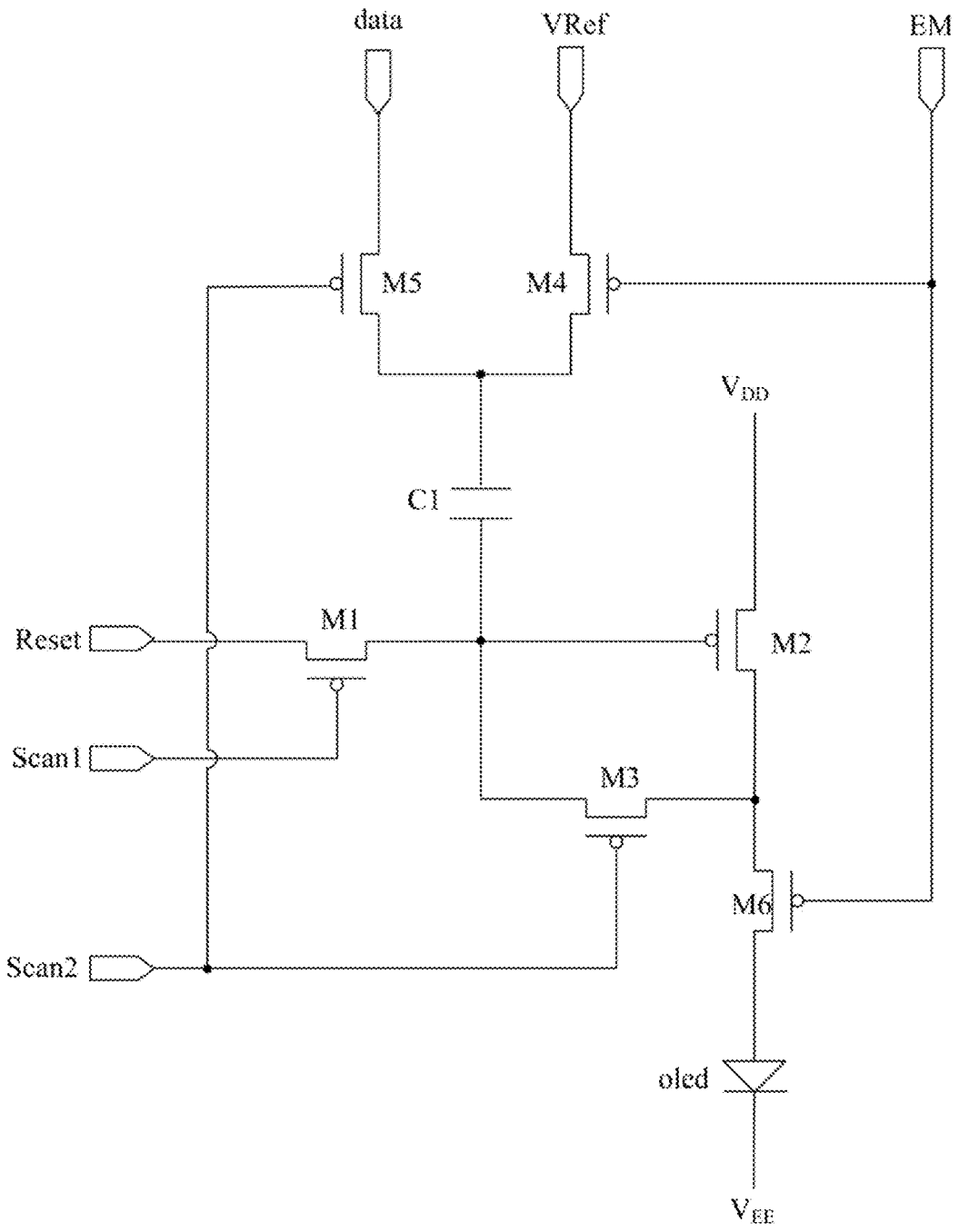
FIG. 5 illustrates a schematic structural diagram of another circuit for a pixel on a display panel according to an embodiment of the disclosure.

It shall be noted that the embodiments above of the disclosure have been described only by way of an example in which a pixel includes at least one switch transistor, a driver transistor, and a light-emitting diode. Those skilled in the art shall appreciate that in the organic light-emitting display panel, in order to perform functions such as compensation for the threshold voltage of the driver transistor. As illustrated in FIG. 5 which is a schematic structural diagram of another circuit for a pixel in a display panel according to an embodiment of the disclosure, the pixel generally includes a plurality of switch transistors, for example, the pixel circuit in FIG. 5 includes 5 switch transistors electrically connected particularly as illustrated, although a repeated description thereof will be omitted here. Of course, the embodiments of the disclosure will not be limited to the two circuits illustrated in the embodiments of FIG. 4 and FIG. 5, but may be any pixel circuit. No matter how many elements are included in the pixel, as long as a pixel in the display panel includes a driver transistor M2 and a light-emitting diode OLED, and current flowing through the light-emitting diode OLED is positively dependent upon the width-to-length ratio of the channel of the driver transistor M2, a display effect arising from the Mach Band effect can be avoided by setting the width-to-length ratio of the channel of the driver transistor of the pixel in the central display region to be greater than the width-to-length ratio of the channel of the driver transistor of the pixel in the edge display region. Particularly in the display panel according to an embodiment of the disclosure, the light-emitting diode can be a general light-emitting diode, or can be a micro-shrunk light-emitting diode, an Organic Light-Emitting Diode (OLED), a quantum-dot light-emitting diode, or another diode structure, for example, although the embodiments of the disclosure will not be limited thereto. The embodiments above have been described only taking an OLED as an example, but will not be limited thereto.

Particularly in the display panel according to an embodiment of the disclosure, the brightness of the pixel can be further controlled by controlling the data voltage on the data line. There is a different corresponding initial data voltage for each pixel at different grayscale, and correspondence relationships between the respective initial data voltages of the respective pixels in the edge display region and target data voltages are predetermined according to a correspondence relationship between the brightness of the pixels and the data voltages, and are pre-stored in a chip of the display panel, so that if a picture is to be displayed on the display panel, then the initial data voltage corresponding to each pixel in the edge display region may be converted into the target data voltage according to the correspondence relationships stored in the chip. Thereafter the picture may be displayed at each pixel in the edge display region according to the target data voltage, and be displayed at each pixel in the central display region according to the initial data voltage, so that the ratio of the brightness of the pixels in the edge display region to the brightness of the pixels in the central display region can reach a desirable value.

Accordingly, particularly in the display panel according to the embodiment of the disclosure, the display panel converts the initial data voltage corresponding to each pixel in the edge display region into the target data voltage corresponding to each pixel in the edge display region according to the pre-stored voltage conversion relationships corresponding to the pixels in the edge display region and displays the picture at the respective pixels in the edge display region according to their corresponding target data voltages. The voltage conversion relationships are derived from preset brightness relationships at the respective grayscales.

Particularly at each grayscale, in order to enable the brightness of the pixels in the edge display region on the display panel to become lower at a longer distance from the central display region, there are different voltage conversion relationships corresponding to the pixels at different positions in the edge display region. Taking the display panel including the edge display region with the width of 3 pixels for example, there are 3 rows of pixels in the edge display region, the brightness of the closest row of pixels to the central display region is 60% of the brightness of the pixels in the central display region, the brightness of the furthest row of pixels from the central display region is 5% of the brightness of the pixels in the central display region, and the brightness of the middle row of pixels is 30% of the brightness of the pixels in the central display region. There are a voltage conversion relationship corresponding to the closest row of pixels in the edge display region to the central display region, a voltage conversion relationship corresponding to the furthest row of pixels in the edge display region from the central display region, a voltage conversion relationship corresponding to the middle row of pixels in the edge display region, and the voltage conversion relationships corresponding to the different rows of pixels are different from each other.

It shall be noted that the display panel according to the embodiment of the disclosure, in which the target data voltage corresponding to each pixel in the edge display region is obtained according to the pre-stored voltage conversion relationship corresponding to the pixel in the edge display region. The picture is displayed at the respective pixels in the edge display region according to their corresponding target data voltages. The picture may not only be applicable to an organic light-emitting display panel, but also to another display panel in which the brightness of light being emitted is determined by data voltage, e.g., a liquid crystal display panel, where the brightness of a pixel in the liquid crystal display panel is produced by applying voltage to a pixel electrode and a common electrode to thereby create an electric field between the pixel electrode and the common electrode so that liquid crystal molecules are rotated by the electric field to thereby let light of a backlight source pass there through, where the light transmittance varies with the varying electric field, so that the brightness of the pixel also varies therewith. The magnitude of the electric field is determined by the voltage on the pixel electrode and the common electrode, where the voltage on the common electrode is generally fixed, and the voltage on the pixel electrode is determined by the data voltage. Of course, those skilled in the art shall appreciate that the embodiments of the disclosure will not be limited thereto.

Particularly the brightness of a pixel in some display panel is dependent upon the area of the pixel in addition to the driver transistor or the data voltage, and for example, since a pixel itself in a liquid crystal display panel cannot emit light, the brightness on the display panel is controlled by controlling the light transmittance of backlight using the pixel. Accordingly if there is a larger area of the pixel in the liquid crystal display panel, then the backlight may be transmitted through a larger area, and the brightness of the pixel may also be higher.

Figure 6:
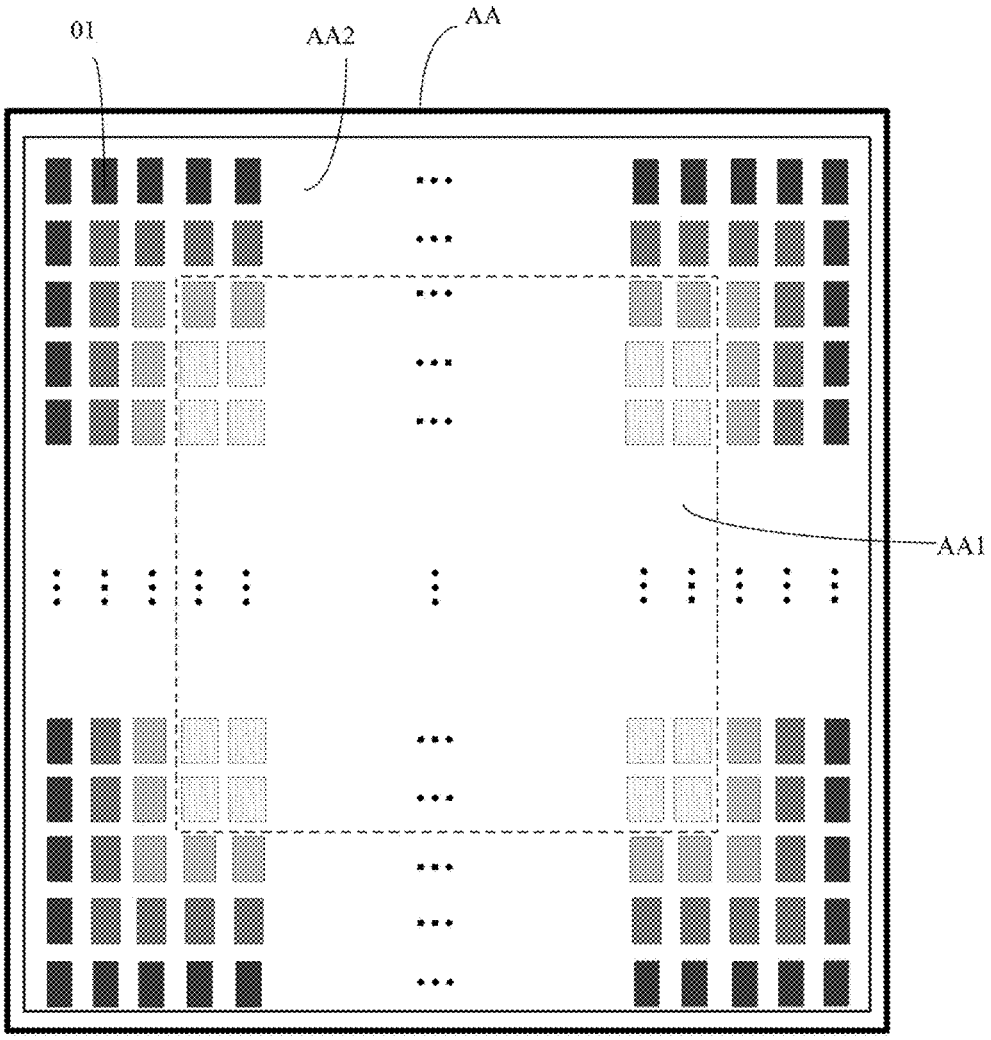
FIG. 6 illustrates a schematic structural diagram of a display panel according to an embodiment of the disclosure.

Accordingly in the display panel according to the embodiment of the disclosure, the pixel includes a pixel driver circuit and a light-emission functional layer, where the pixel driver circuit controls the brightness of the pixel by varying the voltage applied to the light-emission functional layer. As illustrated in FIG. 6 which is a schematic structural diagram of a display panel according to an embodiment of the disclosure, the area of a pixel 01 in the central display region AA1 is greater than the area of a pixel 01 in the edge display region AA2, so that the brightness of the pixel 01 in the edge display region AA2 is lower than the brightness of the pixel 01 in the central display region at each grayscale.

Particularly if the display panel according to the embodiment of the disclosure is a liquid crystal display panel, then the light-emission functional layer in the pixel may include a pixel electrode, a common electrode, and liquid crystals between the pixel electrode and the common electrode.

Particularly in the display panel according to an embodiment of the disclosure, as illustrated in FIG. 6, the area of the pixel 01 in the edge display region AA2 becomes smaller at a longer distance from the central display region AA1, so that the brightness of the pixel 01 in the edge display region AA2 becomes lower at a longer distance from the central display region AA1 at each grayscale.

Particularly in the display panel according to an embodiment of the disclosure, the area of the pixel in the edge display region is smaller than the area of the pixel in the central display region by an area difference which can be determined by a mutual relationship between the area of a pixel and the brightness of the pixel, although the embodiment of the disclosure will not be limited thereto.

Particularly the display panel according to the embodiment of the disclosure in which the area of the pixel in the central display region is larger than the area of the pixel in the edge display region may not only be applicable to a liquid crystal display panel, but also to another display panel in which the brightness of a pixel is related to the area of the pixel.

Those skilled in the art shall appreciate that the area of a pixel in the edge display region, or the data voltage can be varied to thereby lower the brightness in the edge display region in the liquid crystal display panel, but also this can be done otherwise, for example, by lowering the brightness of backlight corresponding to the edge display region, although the embodiments of the disclosure will not be limited thereto.

Figure 7:
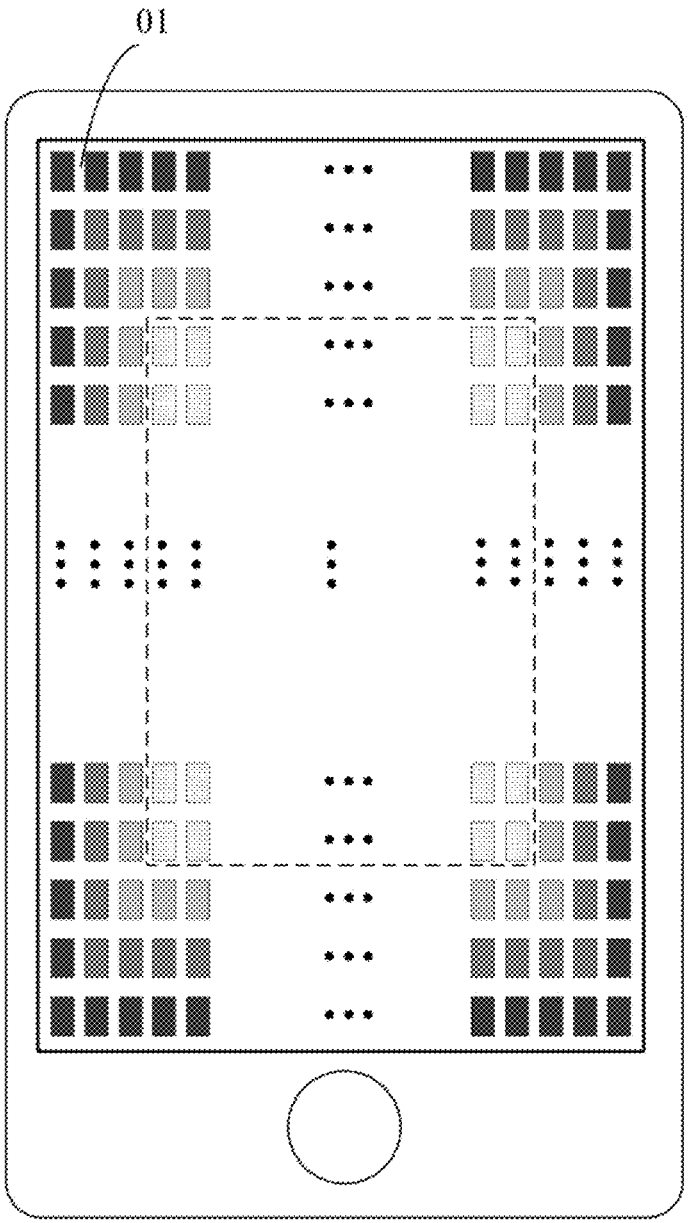
FIG. 7 illustrates a schematic structural diagram of a display device according to an embodiment of the disclosure.

Based upon the same inventive concept, an embodiment of the disclosure further provides a display device as illustrated in FIG. 7 which is a schematic structural diagram of a display device according to an embodiment of the disclosure. The display device includes the display panel according to any one of the embodiments of the disclosure. The display device can be any product or component capable of displaying, such as a mobile phone, a tablet computer, a TV set, a display, a notebook computer, a digital photo frame, a navigator. Reference can be made to the embodiments of the display panel above for an implementation of the display device, so a repeated description thereof will be omitted here.

In the display device according to an embodiment of the disclosure, the display region is divided into the central display region, and the edge display region surrounding the central display region. The brightness of a pixel in the edge display region is lower than the brightness of a pixel in the central display region at each grayscale, so that while a picture is being displayed, the brightness in the edge display region is lower than the brightness in the central display region. However, the edge display region is adjacent to the edge frame of the display panel where no light is emitted, and human eyes perceive higher brightness in the edge display region than the real brightness in the edge display region due to the Mach Band effect, so that the brightness in the central display region perceived by the human eyes agrees with the brightness in the edge display region. Thus alleviating the problem in the existing display panel of such higher brightness in the edge display region than the brightness in the central display region that results in a distinct contour at the edge of the display region.

Based upon the same inventive concept, an embodiment of the disclosure further provides a method for displaying on a display panel including a display region in which there are a plurality of pixels arranged, where the display region includes a central display region, and an edge display region surrounding the central display region; and the display method includes: while a picture is displayed, controlling the brightness of a pixel in the edge display region to be lower than the brightness of a pixel in the central display region at each grayscale.

In the display method according to an embodiment of the disclosure, the brightness of a pixel in the edge display region is controlled to be lower than the brightness of a pixel in the central display region at each grayscale, so that while a picture is being displayed, the brightness in the edge display region is lower than the brightness in the central display region. However, the edge display region is adjacent to the edge frame of the display panel where no light is emitted, and human eyes perceive higher brightness in the edge display region than the real brightness in the edge display region due to the Mach Band effect, so that the brightness in the central display region perceived by the human eyes agrees with the brightness in the edge display region, thus alleviating the problem in the existing display panel of such higher brightness in the edge display region than the brightness in the central display region that results in a distinct contour at the edge of the display region.

Particularly in the display method according to an embodiment of the disclosure, the brightness of a pixel in the edge display region is controlled to be lower than the brightness of a pixel in the central display region at each grayscale particularly as follows.

The brightness of the pixel in the edge display region is controlled to become lower at a longer distance from the central display region at each grayscale. Stated otherwise, there is lower brightness of a pixel in the edge display region closer to the edge of the display panel to thereby lower the brightness contrast between the edge of the display panel and the edge display region, and there is higher brightness of a pixel in the edge display region closer to the central display region to thereby lower the brightness contrast between the edge display region and the central display region. Thus, the difference in brightness between the central display region and the edge display region can be visually eliminated to thereby alleviate in effect the distinctness of the contour at the edge of the display region on the display panel.

The display method according to an embodiment of the disclosure will be described below in details in connection with the structure of the display panel.

Figure 8:
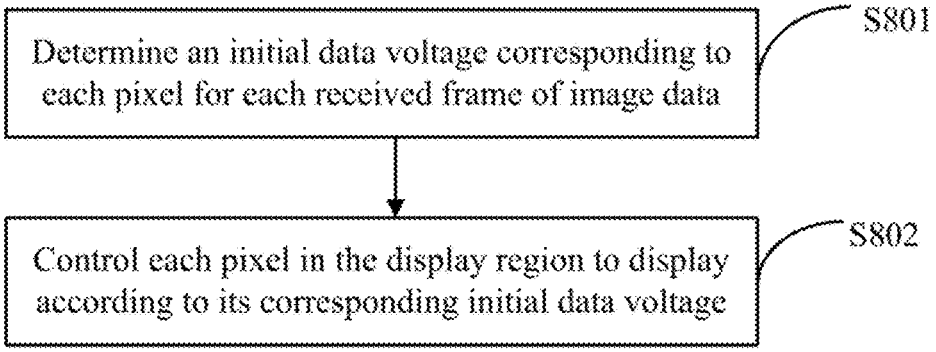
FIG. 8 illustrates a schematic flow chart of a display method according to an embodiment of the disclosure.

Particularly in the display method according to an embodiment of the disclosure, as illustrated in FIG. 8 which is a schematic flow chart of a display method according to an embodiment of the disclosure, the brightness of the pixel in the edge display region is controlled to be lower than the brightness of the pixel in the central display region in the following steps.

Step S801 is to determine an initial data voltage corresponding to each pixel for each received frame of image data.

Step S802 is to control each pixel in the display region to display according to its corresponding initial data voltage.

Each pixel includes at least one switch transistor, a driver transistor, and a light-emitting diode, an output end of the switch transistor is electrically connected with a gate of the driver transistor, an output end of the driver transistor is electrically connected with an input end of the light-emitting diode, and the width-to-length ratio of the channel of the driver transistor of the pixel in the central display region is greater than the width-to-length ratio of the channel of the driver transistor of the pixel in the edge display region.

In the display method above, the picture is displayed at each pixel according to its corresponding initial data voltage. The width-to-length ratio of the channel of the driver transistor of the pixel in the central display region is greater than the width-to-length ratio of the channel of the driver transistor of the pixel in the edge display region, so if the pixel in the central display region and the pixel in the edge display region are provided with the same voltage, then current actually applied to the light-emitting diode in the edge display region to emit light may be smaller than current applied to the light-emitting diode in the central display region to emit light, due to the different width-to-length ratios of the channels of the driver transistors. As a result, the real brightness of the pixel in the edge display region may be lower than the real brightness of the pixel in the central display region despite the same data voltage input thereto.

Particularly in another display method according to an embodiment of the disclosure, as illustrated in FIG. 8, the brightness of the pixel in the edge display region is controlled to be lower than the brightness of the pixel in the central display region in the following steps.

Step S801 is to determine an initial data voltage corresponding to each pixel for each received frame of image data.

Step S802 is to control each pixel in the display region to display according to its corresponding initial data voltage.

Each pixel includes a pixel driver circuit and a light-emission functional layer, where the pixel driver circuit controls the brightness of the pixel by varying the voltage applied to the light-emission functional layer, and the area of the pixel in the central display region is larger than the area of the pixel in the edge display region.

In the display method above, the picture is displayed at each pixel according to its initial data voltage. The area of the pixel in the central display region is larger than the area of the pixel in the edge display region, so if the pixel in the central display region and the pixel in the edge display region are provided with the same voltage, then the real brightness of the pixel in the edge display region may be lower than the real brightness of the pixel in the central display region due to the different areas of the pixels.

Figure 9:
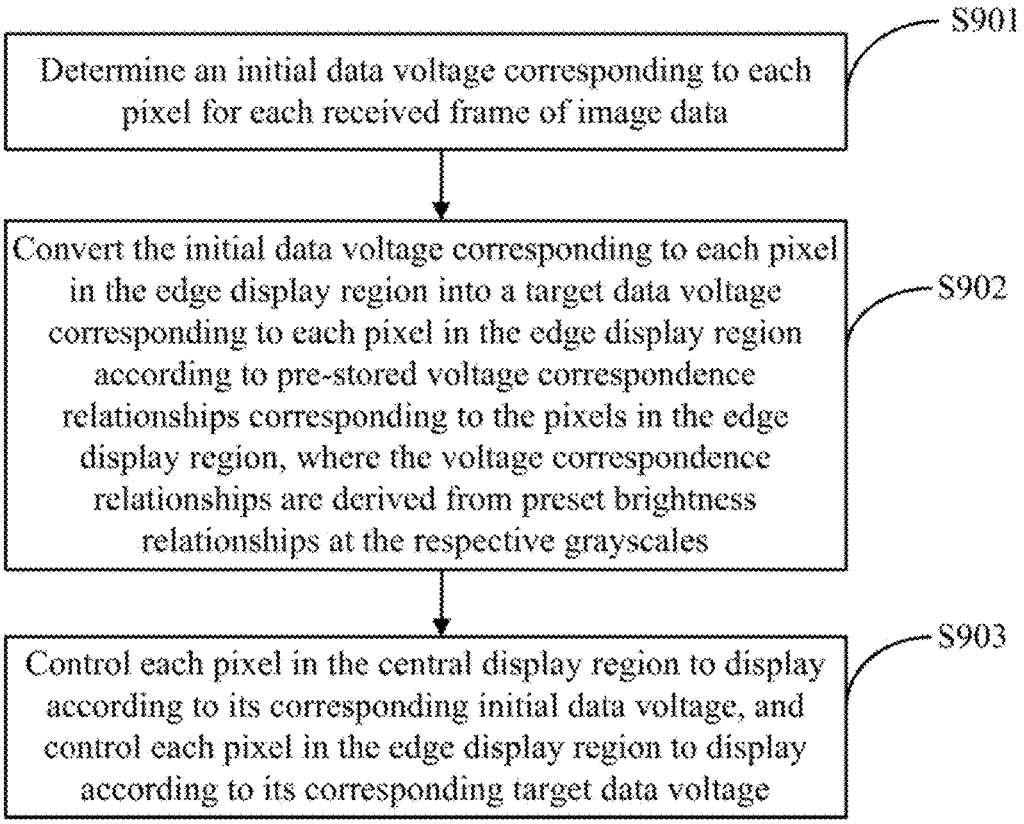
FIG. 9 illustrates a schematic flow chart of another display method according to an embodiment of the disclosure.

Particularly in the display method according to the embodiment of the disclosure, as illustrated in FIG. 9 which is a schematic flow chart of another display method according to an embodiment of the disclosure, the display method particularly includes the following steps.

Step S901 is to determine an initial data voltage corresponding to each pixel for each received frame of image data.

Step 902 is to convert the initial data voltage corresponding to each pixel in the edge display region into a target data voltage corresponding to each pixel in the edge display region according to pre-stored voltage correspondence relationships corresponding to the pixels in the edge display region, where the voltage correspondence relationships are derived from preset brightness relationships at the respective grayscales.

Step S903 is to control each pixel in the central display region to display according to its corresponding initial data voltage, and control each pixel in the edge display region to display according to its corresponding target data voltage.

In the display method above, at the same grayscale, the pixels in the central display region are provided with the initial data voltage, and the pixels in the edge display region are provided with the target data voltage into which the initial data voltage is converted according to the preset brightness relationships, so if the picture is displayed at the pixels in the central display region and the pixels in the edge display region at the same grayscale, then the real brightness of the pixels in the edge display region may be lower than the real brightness of the pixels in the central display region due to different data voltages provided to the pixels.

In the display panel, the method for displaying on the same, and the display device according to the embodiments of the disclosure, the display region is divided into the central display region, and the edge display region surrounding the central display region. At each grayscale, the brightness of a pixel in the edge display region is lower than the brightness of a pixel in the central display region, so that while a picture is being displayed, the brightness in the edge display region is lower than the brightness in the central display region, but the edge display region is adjacent to an edge frame of the display panel where no light is emitted, and human eyes perceive higher brightness in the edge display region than the real brightness in the edge display region due to the Mach Band effect. Thus, the brightness in the central display region perceived by the human eyes agrees with the brightness in the edge display region, thus alleviating the problem in the existing display panel of such higher brightness in the edge display region than the brightness in the central display region that results in a distinct contour at the edge of the display region.

Evidently those skilled in the art can make various modifications and variations to the disclosure without departing from the spirit and scope of the disclosure. Accordingly the disclosure is also intended to encompass these modifications and variations thereto so long as the modifications and variations come into the scope of the claims appended to the disclosure and their equivalents.

The invention claimed is:

1. A display panel, comprising:

a display region comprising:

a central display region comprising a plurality of first pixels; and an edge display region surrounding the central display region, wherein the edge display region comprises a plurality of second pixels, wherein a second brightness of each of the plurality of second pixels in the edge display region is lower than a first brightness of each of the plurality of first pixels in the central display region at each grayscale;

wherein the display panel displays the first brightness on each of the plurality of first pixels in the central display region set by an initial first data voltage;

wherein the display panel converts an initial second data voltage on each of the plurality of second pixels in the edge display region into a target data voltage according to a pre-stored voltage conversion rule, then the display panel displays the second brightness at each of the plurality of second pixels in the edge display region based on the target data voltage; and wherein the pre-stored voltage conversion rule is derived from a preset brightness at each grayscale.

2. The display panel according to claim 1, wherein the second brightness of the plurality of second pixels each in the edge display region is no greater than 60% of the first brightness of the plurality of first pixels each in the central display region at each grayscale.

3. The display panel according to claim 1, wherein a width of the edge display region is a width of 1 to 10 pixels of the plurality of second pixels.

4. The display panel according to claim 1, wherein the plurality of first pixels each comprises at least one first switch transistor, a first driver transistor, and a first light-emitting diode, an output end of the first switch transistor is electrically connected with a first gate of the first driver transistor, and an output end of the first driver transistor is electrically connected with an input end of the first light-emitting diode;

wherein the plurality of second pixels each comprises at least one second switch transistor, a second driver transistor, and a second light-emitting diode, an output end of the second switch transistor is electrically connected with a second gate of the second driver transistor, and an output end of the second driver transistor is electrically connected with an input end of the second light-emitting diode; and a first width-to-length ratio of a first channel of the first driver transistor of the plurality of first pixels in the central display region is greater than a second width-to-length ratio of a second channel of the second driver transistor of the plurality of second pixels in the edge display region.

5. The display panel according to claim 4, wherein the second width-to-length ratio of the second channel of the second driver transistor in the edge display region is arranged to be smaller at a longer distance from the central display region.

6. The display panel according to claim 1, wherein the second brightness of each of the plurality of second pixels a pixel in the edge display region becomes lower at a longer distance from the central display region at each grayscale.

7. The display panel according to claim 6, wherein the second brightness of the furthest pixel of the plurality of second pixels in the edge display region from the central display region is no greater than 5% of the first brightness of each of the plurality of first pixels in the central display region at each grayscale.

8. The display panel according to claim 6, wherein the second brightness of each of the plurality of second pixels adjacent to the central display region is 40% to 60% of the first brightness of the plurality of first pixels each in the central display region at each grayscale.

9. A display device, comprising the display panel according to claim 1.

10. The display device according to claim 9, wherein the second brightness of the plurality of second pixels in the edge display region is no greater than 60% of the first brightness of the plurality of first pixels in the central display region at each grayscale.

11. The display device according to claim 9, wherein a width of the edge display region is a width of 1 to 10 pixels of the plurality of second pixels.

12. The display device according to claim 9, wherein the second brightness of the plurality of second pixels in the edge display region becomes lower at a longer distance from the central display region at each grayscale.

13. A method for displaying on a display panel, wherein the display panel comprises a display region, wherein the display region comprises a central display region having a plurality of first pixels, and an edge display region surrounding the central display region and having a plurality of second pixels;

wherein the method for displaying comprises:

while a picture is displayed, controlling a second brightness of the plurality of second pixels in the edge display region to be lower than a first brightness of the plurality of first pixels in the central display region at each grayscale;

wherein the method for display further comprises:

determining an initial second data voltage on the plurality of second pixels each for each received frame of image data;

converting the initial second data voltage on each of the plurality of second pixels in the edge display region into a target data voltage according to a pre-stored voltage conversion rule, wherein the voltage conversion rule is derived from a preset brightness at each grayscale;

controlling each pixel of the plurality of first pixels in the central display region to display based on an initial first data voltage; and controlling each pixel of the plurality of second pixels in the edge display region to display based on the target second data voltage.

14. The method of displaying according to claim 13, wherein the controlling the second brightness of the plurality of second pixels in the edge display region to be lower than the brightness of the plurality of first pixels in the central display region further comprises:

arranging the second brightness of the plurality of second pixels in the edge display region to become lower at a longer distance from the central display region at each grayscale.

15. The method of displaying according to claim 13, wherein the controlling the second brightness of the plurality of second pixels in the edge display region to be lower than the first brightness in the central display region further comprises:

determining the initial first and second data voltages corresponding to each pixel of the plurality of first and second pixels for each received frame of image data; and controlling each pixel of the plurality of first pixels in the display region to display according to the initial first data voltage;

wherein each pixel of the plurality of first pixels comprises at least one first switch transistor, a first driver transistor, and a first light-emitting diode, an output end of the first switch transistor is electrically connected with a first gate of the first driver transistor, and an output end of the first driver transistor is electrically connected with an input end of the first light-emitting diode;

wherein each pixel of the plurality of second pixels comprises at least one second switch transistor, a second driver transistor, and a second light-emitting diode, an output end of the second switch transistor is electrically connected with a second gate of the second driver transistor, and an output end of the second driver transistor is electrically connected with an input end of the second light-emitting diode; and a first width-to-length ratio of a first channel of the first driver transistor of the plurality of first pixels each in the central display region is greater than a second width-to-length ratio of the second channel of the second driver transistor of the plurality of second pixels each in the edge display region.

16. A display panel, comprising:

a display region comprising:

a central display region comprising a plurality of first pixels; and an edge display region surrounding the central display region, wherein the edge display region comprises a plurality of second pixels, wherein a second brightness of each of the plurality of second pixels in the edge display region is lower than a first brightness of each of the plurality of first pixels in the central display region at each grayscale;

wherein the plurality of first pixels each comprises a first pixel driver circuit and a first light-emission functional layer, wherein the first pixel driver circuit controls the first brightness of the plurality of first pixels by varying a voltage applied to the first light-emission functional layer;

wherein the plurality of second pixels each comprises a second pixel driver circuit and a second light-emission functional layer, wherein the second pixel driver circuit controls the second brightness of the plurality of second pixels by varying a voltage applied to the second light-emission functional layer; and wherein a first area of one pixel of the plurality of first pixels in the central display region is larger than a second area of one pixel of the plurality of second pixels in the edge display region.

17. The display panel according to claim 16, wherein the second area in the edge display region is arranged to be smaller at a longer distance from the central display region.

18. A display device, comprising the display panel according to claim 16.

19. A method for displaying on the display panel according to claim 16, wherein the method of displaying comprises:

while a picture is displayed, controlling the second brightness of the plurality of second pixels in the edge display region to be lower than the first brightness of the plurality of first pixels in the central display region at each grayscale;

wherein the controlling the second brightness of the plurality of second pixels in the edge display region to be lower than the first brightness of the plurality of first pixels in the central display region comprises:

determining an initial first data voltage for the plurality of first pixels each and an initial second data voltage for the plurality of second pixels each for every received frame of image data;

controlling the plurality of first pixels in the central display region to display based on the initial first data voltage; and controlling the plurality of second pixels in the edge display region to display base on the initial second data voltage.

* * * * *